US005097688A

United States Patent [19]

Taylor et al.

[11] Patent Number: 5,097,688

[45] Date of Patent: Mar. 24, 1992

[54] IN-LINE WIRE DRAWING MACHINE WITH OVERHEAD TURNTABLE

[75] Inventors: Timothy J. Taylor, Rockford; Richard A. Alcock; Michael J. Yankaitis, both of Roscoe, all of Ill.

[73] Assignee: Rockford Manufacturing Group, Inc., Roscoe, Ill.

[21] Appl. No.: 661,410

[22] Filed: Feb. 26, 1991

[51] Int. Cl.[5] ..... B21C 1/02

[52] U.S. Cl. ..... 72/5; 72/278; 72/280; 72/289

[58] Field of Search ..... 72/289, 287, 290, 280, 72/278

[56] References Cited

U.S. PATENT DOCUMENTS

| | | | |
|---|---|---|---|
| 221,254 | 11/1879 | Rogers | 72/289 |
| 407,612 | 7/1889 | Rawson | 72/289 |
| 440,133 | 11/1890 | Burnes . | |
| 1,865,781 | 7/1932 | Najarian . | |
| 3,339,396 | 9/1967 | Carlson | 72/289 |
| 3,709,021 | 1/1973 | Jackman | 72/289 |

FOREIGN PATENT DOCUMENTS

| | | | |
|---|---|---|---|
| 8917 | 8/1907 | United Kingdom | 72/289 |
| 1035482 | 7/1966 | United Kingdom | 72/289 |
| 2046648 | 11/1980 | United Kingdom | 72/289 |

*Primary Examiner*—Daniel C. Crane

*Attorney, Agent, or Firm*—Leydig, Voit & Mayer

[57] ABSTRACT

An in-line wire drawing machine includes a power-driven capstan rotatable about a horizontal axis and operable to unwind wire from a coil and to pull the wire through a drawing die for reducing the diameter of the wire. In order to conserve floor space, the coil is supported on an overhead turntable located above the capstan and rotatable about a vertical axis to enable unwinding of the coil. Wire unwound from the coil is directed rearwardly therefrom to a pair of guide rollers, proceeds downwardly alongside the rear of the machine and then travels forwardly to the die. A tangle detector is located upstream of the die and automatically shuts down the machine if the wire in the coil becomes tangled or snagged and fails to pay off of the coil in a free manner.

7 Claims, 3 Drawing Sheets

IN-LINE WIRE DRAWING MACHINE WITH OVERHEAD TURNTABLE

BACKGROUND OF THE INVENTION

This invention relates to an in-line wire drawing machine for unwinding wire from a coil of wire, for reducing the diameter of the wire and for supplying the reduced-diameter wire to a using station such as a cold header located downstream of the wire drawing machine. An in-line wire drawing machine of this general type is disclosed in Alcock et al U.S. Pat. No. 4,099,403.

In such a machine, the wire is initially wound in a coil which is supported on a rotatable turntable. Wire from the coil is threaded through a drawing die and then is wrapped several times around a power-rotated drum or capstan. When the capstan is rotated, it pulls wire through the drawing die so as to reduce the diameter thereof, the reduced diameter wire first winding onto one end of the capstan and then unwinding from the other end of the capstan for supply to the using station. As the wire is pulled by the capstan, the turntable rotates in order to allow the wire to unwind from the coil and to proceed to the drawing die.

Conventionally, the turntable is mounted on a floor-supported base and is located near floor level behind the rear or upstream end of the main frame which supports the capstan. As a result, the overall machine is relatively long and occupies significant floor space. When several machines are located in a facility, the total floor space taken up by the rearwardly located turntables is an economic detriment.

SUMMARY OF THE INVENTION

The general aim of the present invention is to shorten the overall length of an in-line wire drawing installation so as to reduce the floor space required by the installation.

A more detailed object of the invention is to achieve the foregoing by providing a new and improved in-line wire drawing machine with an overhead turntable which is located above the capstan in order to free up and conserve the space behind the main frame of the capstan.

A further object is to guide the wire rearwardly from the overhead capstan and around to the drawing die in a reliable and trouble-free manner.

The invention also resides in the provision of a novel mechanism for detecting any tangles in the wire of the coil and for automatically shutting down the machine if the wire snags and fails to pay off of the coil in a free manner.

These and other objects and advantages of the invention will become more apparent from the following detailed description when taken in conjunction with the accompanying drawings.

DETAILED DESCRIPTION OF THE PREFERRED EMBODIMENT

Figures 1, 2:
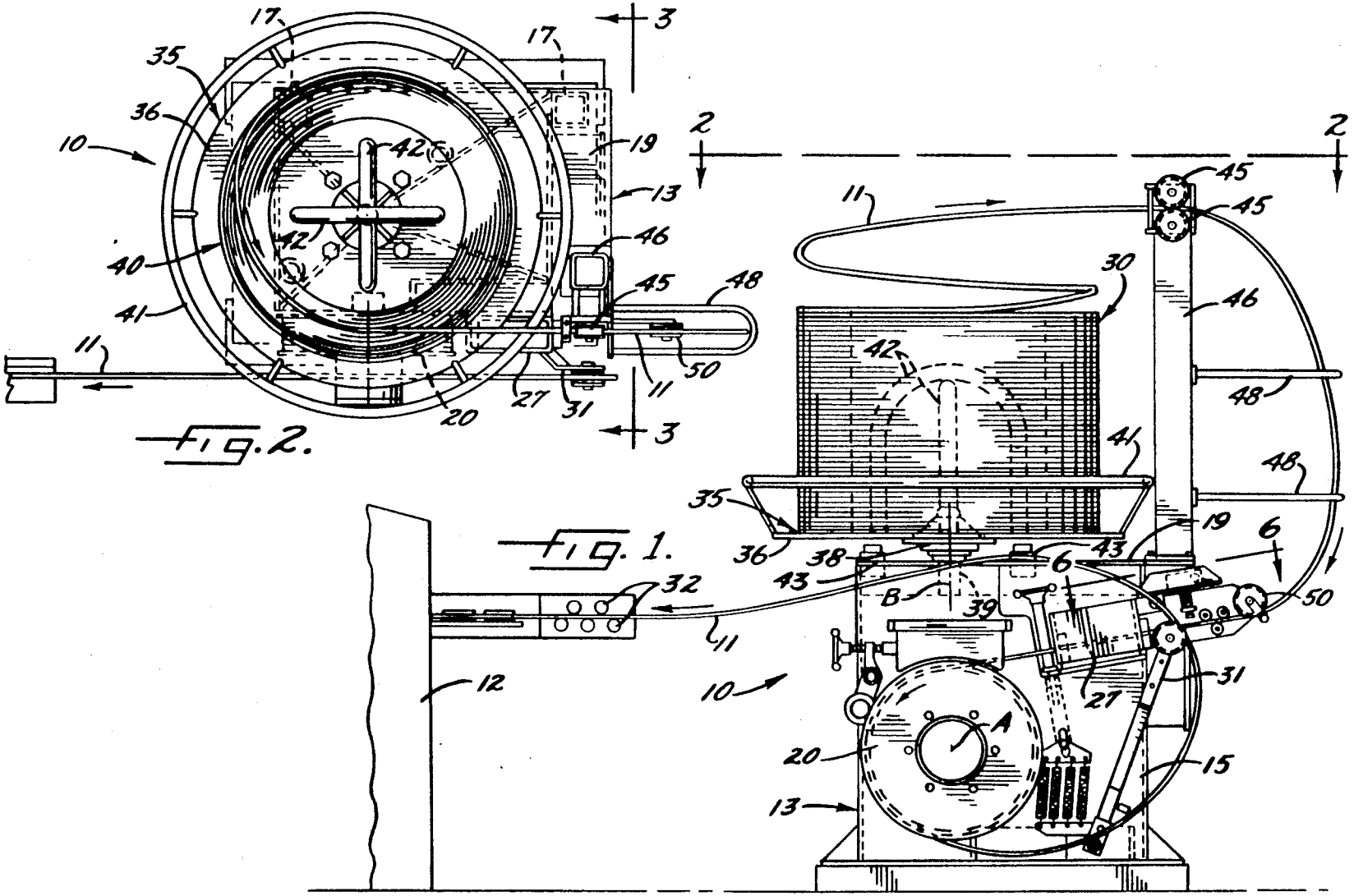
FIG. 1 is a side elevational view of a new and improved in-line wire drawing machine incorporating the unique features of the present invention.
FIG. 2 is a top plan view of the machine as seen from the line 2—2 of FIG. 1.

For purposes of illustration, the invention has been shown in the drawings as embodied in an in-line wire drawing machine 10 for reducing the diameter of wire 11 and for supplying the wire to a using machine 12 which herein has been shown as being a cold header. Many aspects of the present machine are similar to those of the machine disclosed in the aforementioned Alcock et al patent and will be described only briefly.

The machine 10 includes a main support or frame 13 (FIG. 4) defined by a lower base plate 14, an upstanding side wall 15, upstanding posts 17, and a horizontal top plate 19. A drum or capstan 20 is supported on the frame 13 for rotation about a generally horizontal and laterally extending axis A (FIG. 1). Rotation of the capstan is effected by an electric motor 24 (FIG. 3) which drives the capstan by way of a variable speed drive mechanism 25.

Figure 6:
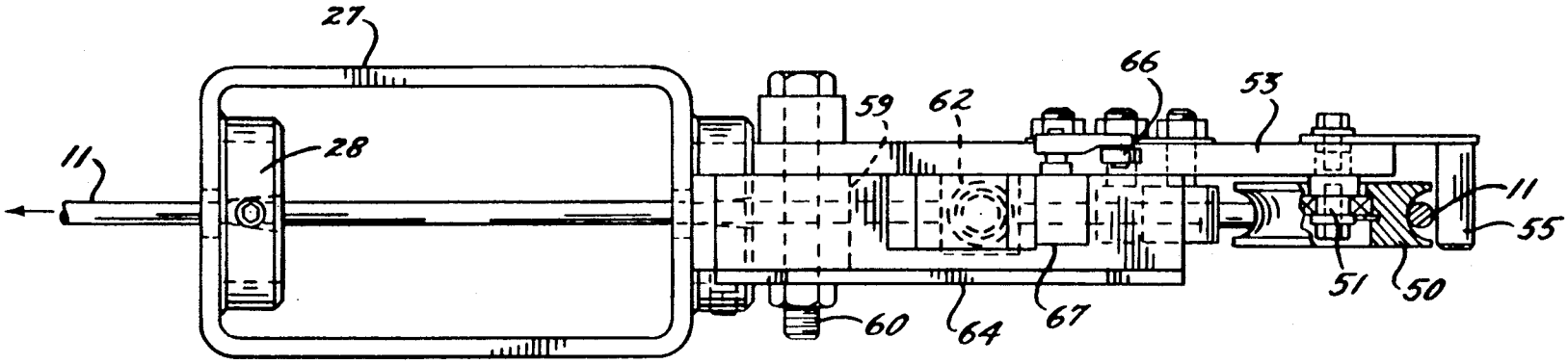
FIG. 6 is an enlarged top plan view of certain components illustrated in FIG. 1 and as seen from the line 6—6 of FIG. 1, certain parts being broken away and shown in section.

Mounted on one side wall 15 of the frame 13 and located to the rear of the capstan 20 is a die box 27 (FIGS. 1, 6 and 7) which supports a wire drawing die 28. Wire 11 from a coil 30 (FIGS. 1, 3 and 4) is threaded through the dies and then makes several wraps around the capstan. An exiting length of wire from the capstan is formed into a loop by a compensating arm 31 (FIG. 1) and then proceeds to intermittently rotatable feed rolls 32 associated with the cold header 12.

When the capstan 20 is rotated, wire 11 from the coil 30 is pulled through the die 28 by the capstan and is reduced in diameter. The reduced diameter wire winds onto and then exits from the capstan and is made available to the cold header 12. The compensating arm 31 acts in a conventional manner to match the speed of rotation of the capstan with the demand of the cold header.

In a typical wireworking operation, several wire drawing machines 10 and using machines 12 are installed in a single facility and occupy a large amount of floor space. According to the present invention, significant floor space is conserved by supporting the wire coil 30 on an overhead turntable 35 which is located above the machine frame 13. Thus, otherwise unusable space above the frame is occupied by the coil 30 and the turntable 35 so as to free up floor space behind the wire drawing machine 10 and to reduce the floor space requirements of the machine.

Figure 3:
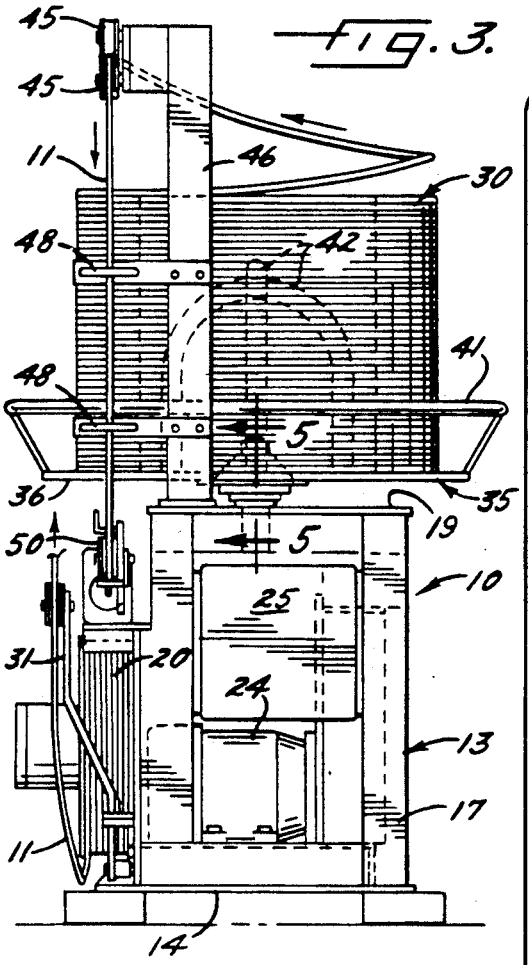
FIG. 3 is a rear elevational view as seen from the line 3—3 of FIG. 2.
Figure 5:
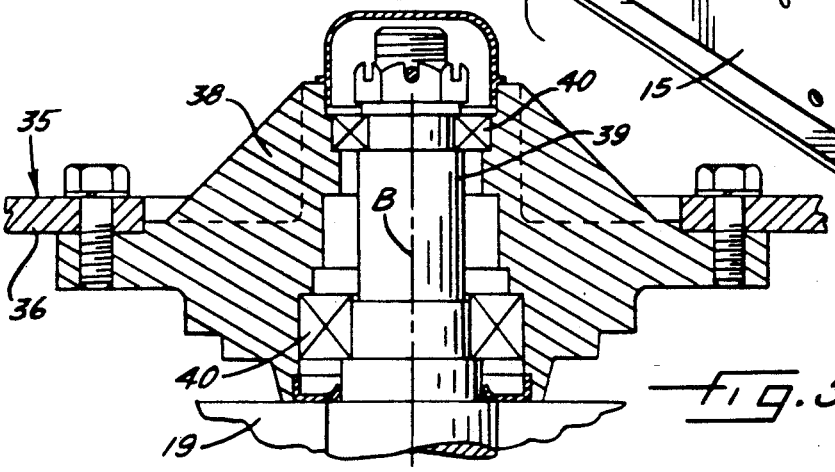
FIG. 5 is an enlarged fragmentary cross-section taken substantially along the line 5—5 of FIG. 3.

More specifically, the turntable 35 includes a circular base plate 36 which is located above and in parallel relation to the top plate 19 of the frame 13. A hub 38 (FIG. 5) at the center of the base plate 36 is supported to rotate about a vertical shaft 39 which is fixed to and projects upwardly from the top plate 19, there being bearings 40 between the shaft and the hub. In this particular instance, the shaft is positioned in a fore-and-aft direction such that its axis B (FIGS. 1 and 5) intersects the axis A of the capstan 20. It is not essential, however, that the axis B intersect the axis A and, as a practical matter, the advantages of the invention usually may be realized if the axis B of the turntable 30 is positioned in the fore-and-aft direction such that it lies between two vertical planes extending tangent to the front and rear peripheral surfaces of the capstan 20. The axis B may be located laterally at the lateral center of the top plate 19 or, as in the preferred embodiment, is offset somewhat from the lateral center and in the direction of the capstan as shown in FIG. 3.

Figure 4:
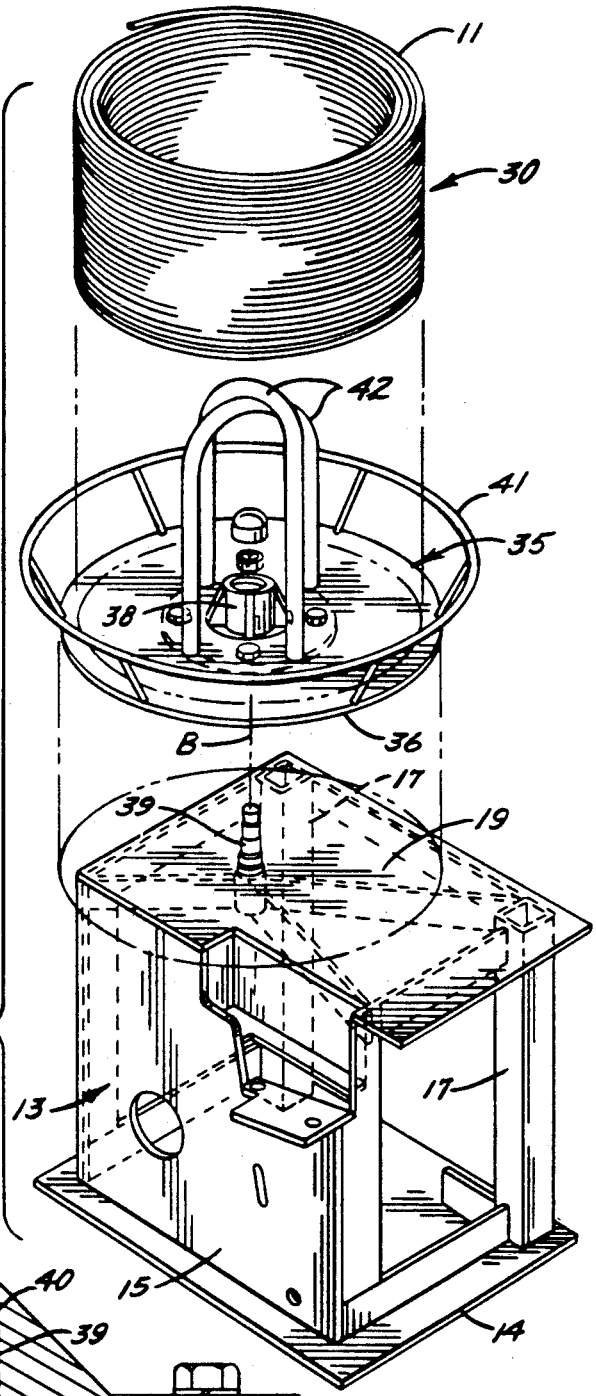
FIG. 4 is an exploded perspective view of the wire coil, the turntable and the machine frame.

As shown most clearly in FIG. 4, the turntable 35 includes a circular basket-like structure 41 attached to the periphery of the base plate 36 and extending upwardly therefrom. A pair of inverted U-shaped rods 42 extend upwardly from the center portion of the base plate and define a mandrel for the coil 30. When placed onto the turntable, the coil is telescoped downwardly over the rods 42 and its lower end portion is encircled by the basket 41. As wire 11 is drawn through the die 28 by the capstan 20, the wire is pulled off of the upper end of the coil and, to permit the wire to unwind evenly from the coil, the turntable 35 rotates about the shaft 39. The turntable is not power-driven but instead is free-wheeling and is rotated by virtue of the pulling force applied to the wire by the capstan. When the motor 24 is de-energized to stop the capstan, air cylinders 43 (FIG. 1) on the top plate 19 are pressurized. The rods of the cylinders extend upwardly and frictionally engage the lower side of the plate 36 to brake the turntable to a stop and prevent uncontrolled unwinding of the coil 30.

Means are provided for guiding the wire 11 rearwardly, downwardly and then forwardly from the upper turn of the coil 30 to the die 28. Herein, these means comprise a pair of grooved rollers 45 (FIGS. 1 and 3) located in vertically superimposed relation at the rear of the coil above the upper turn thereof. The rollers 45 are supported to turn about horizontal axes paralleling the axis A of the capstan 20 by a vertical post 46 fixed to and extending upwardly from the rear end portion of the top plate 19 of the frame 13. Wire 11 from the upper turn of the coil 30 passes rearwardly between the rollers 45 and then loops downwardly behind the post. Two vertically spaced and U-shaped restrainer bars 48 extend rearwardly from the post and control the trailing end portion of the wire upon depletion of the coil.

Advantageously, means are provided for detecting any tangles in the wire 11 and for automatically shutting down the machine 10 if the wire snags and is prevented from freely paying off of the coil 30. In the present instance, these means comprise a grooved roller 50 (FIGS. 6 and 7) supported to rotate by a horizontal stub shaft 51 on the rear end portion of a member or plate 53. Wire 11 from the guide rollers 45 loops beneath the roller 50 and is constrained by a laterally extending finger 55 on the plate 53. After traveling by the roller 50, the wire threads between two upper straightening rollers 57 and a lower straightening roller 58 before passing to the die 28.

Pursuant to the invention, the forward end portion of the plate 53 is connected to a fixed ear 59 (FIG. 7) on the die box 27 by a laterally extending pivot bolt 60 which supports the plate to swing upwardly and downwardly. A spring 62 acts between an extension 64 of the ear and a fixed bolt 65 on the plate 53 and urges the plate to swing downwardly about the pivot bolt 60, the spring normally holding the plate in the position shown in FIG. 7. When the plate pivots upwardly through a predetermined angle, its upper edge engages the actuator 66 of a limit switch 67 on the extension 64 and causes the switch to open and interrupt electrical power to the machine 10.

Figure 7:
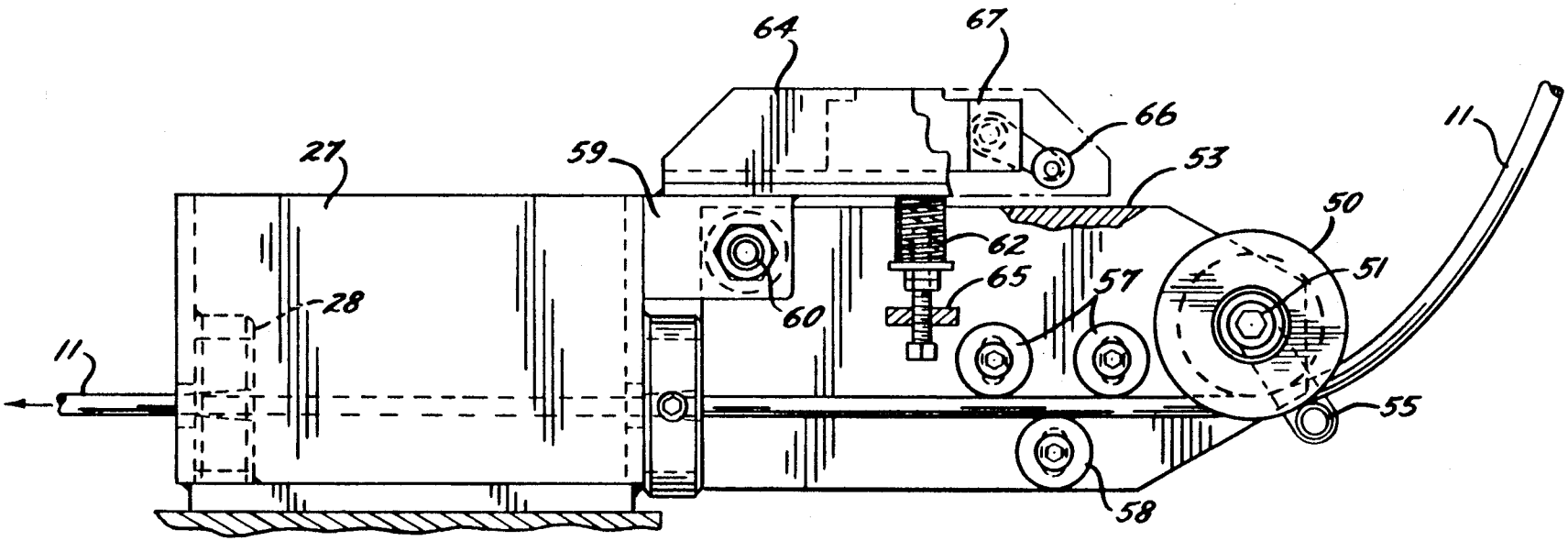
FIG. 7 is a side elevational view of the components shown in FIG. 6.

Normally, the wire 11 pays evenly off of the coil 30 and thus the plate 53 remains positioned as shown in FIG. 7. If the wire on the coil becomes tangled, or if a large burr on the wire prevents the wire from paying smoothly off of the coil, the wire snags and an upward force is exerted on that portion of the wire between the rollers 45 and the roller 50. Such force acts against the roller 50 and causes the plate 53 to pivot upwardly and trip the limit switch 67. This deenergizes the drive motor 24 of the capstan 20 and shuts the machine 10 down until the problem is corrected. In this way, operation of the machine is interrupted so as to prevent the capstan from compounding the tangle or pulling on a snagged wire and causing the wire to break. Closure of the switch 67 also shuts down the cold header 12.

From the foregoing, it will be apparent that the present invention brings to the art a new and improved in-line wire drawing machine 10 in which considerable floor space is saved by virtue of mounting the turntable 35 above the capstan 20 rather than on the floor behind the machine. In spite of the overhead position of the turntable, the guide rollers 45 provide a controlled feed of the wire to the dies 28 while the snag detector 50, 53 and 67 insures against the machine being operated if the wire becomes tangled.

We claim:

1. An in-line wire drawing machine for unwinding wire from a coil of wire, for reducing the diameter of the wire and for supplying the reduced-diameter wire to a using station located downstream of the machine, said machine comprising a support, a capstan mounted on said support to rotate about a generally horizontal axis, power-operated means for rotating said capstan about said axis, a wire drawing die mounted on said support and located upstream of said capstan, there being wire from said coil threaded through said die and wrapped around said capstan whereby rotation of said capstan draws said wire through said die and supplies wire off of said capstan for consumption by said using station, said capstan being located between first and second vertical planes extending tangent to the capstan, said first vertical plane being proximate to said die, said second vertical plane being remote from said die, means for supporting said coil of wire and enabling said coil to unwind in response to rotation of said capstan so as to provide a supply of wire to said die, said supporting means comprising a turntable located above the upper side of said capstan, means mounting said turntable on said support for rotation about a generally vertical axis located between said die and said second vertical plane, and means for guiding wire from the coil on said turntable to said die as the wire is played off of said coil.

2. An in-line wire drawing machine as defined in claim 1 in which the generally vertical axis of said turntable is located between said first and second vertical planes.

3. An in-line wire drawing machine as defined in claim 2 in which the generally vertical axis of said turntable intersects the generally horizontal axis of said capstan.

4. An in-line wire drawing machine as defined in claim 1 in which said guide means comprise a pair of vertically spaced coacting rollers rotatable about horizontal axes paralleling the axis of the capstan and located downstream of said turntable at a higher elevation than the turntable.

5. An in-line wire drawing machine as defined in claim 1 further including means located upstream of said die for sensing a tangle in said wire and for automatically disabling said means for rotating said capstan in response to detecting a tangle.

6. An in-line wire drawing machine as defined in claim 5 in which said tangle sensing means comprise a member mounted to pivot upwardly and downwardly on said support, means for biasing said member downwardly, roller means on said member and engageable with said wire to cause said member to pivot upwardly in response to said roller means being subjected to an upward force, and means for disabling said capstan rotating means when said member is pivoted upwardly through a predetermined angle.

7. An in-line wire drawing machine as defined in claim 1 in which said turntable is mounted for free-wheeling rotation about said generally vertical axis, and means for selectively applying a braking force to said turntable.

* * * * *